US010241472B2

(12) United States Patent
Peters et al.

(10) Patent No.: US 10,241,472 B2
(45) Date of Patent: Mar. 26, 2019

(54) MODULAR TIMEPIECE MOVEMENT WITH FUNCTIONAL MODULES

(71) Applicant: ETA SA Manufacture Horlogere Suisse, Grenchen (CH)

(72) Inventors: Jean-Bernard Peters, Pieterlen (CH); Laurent Kaelin, Sonvilier (CH); Ivan Villar, Bienne (CH); Raphael Balmer, Courrendlin (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 466 days.

(21) Appl. No.: 13/710,737

(22) Filed: Dec. 11, 2012

(65) Prior Publication Data

US 2013/0148479 A1 Jun. 13, 2013

(30) Foreign Application Priority Data

Dec. 13, 2011 (EP) ..... 11193174

(51) Int. Cl.
*G04B 1/00* (2006.01)
*G04B 5/00* (2006.01)
(Continued)

(52) U.S. Cl.
CPC ..... *G04B 13/00* (2013.01); *G04B 1/00* (2013.01); *G04B 5/00* (2013.01); *G04B 15/14* (2013.01);
(Continued)

(58) Field of Classification Search
CPC ..... G04B 29/00; G04B 29/02; G04B 29/022; G04B 29/027
(Continued)

(56) References Cited

U.S. PATENT DOCUMENTS 3,802,183 A * 4/1974 Erard ..... 368/125
3,901,018 A * 8/1975 Erard ..... 368/300
(Continued)

FOREIGN PATENT DOCUMENTS

CH 647 125 G A3 1/1985
EP 0 862 098 A2 9/1998
(Continued)

OTHER PUBLICATIONS

Adams, Ariel, "Inside Dubois-Depraz-Empire of the Watch Movement Module", Oct. 12, 2011, A Blog to Watch, Retrieved from <http://www.ablogtowatch.com/inside-dubois-depraz-empire-of-the-watch-movement-module/>.*
(Continued)

*Primary Examiner* — Daniel P Wicklund
(74) *Attorney, Agent, or Firm* — Oblon, McClelland, Maier & Neustadt, L.L.P.

(57) ABSTRACT

A mechanical timepiece movement in the form of a modular unit. The movement includes at least one modular unit for performing a particular timepiece function, which is irremovably pre-adjusted by irremovably securing adjustment and/or assembling components included in the functional module after the particular horological function has been adjusted and function checked on the test bench. The pre-adjusted functional module is irremovably secured to a plate included in the movement or included in another pre-adjusted functional module of the movement, or irremovably secured to another pre-adjusted functional module included in the movement.

30 Claims, 7 Drawing Sheets

(51) Int. Cl.

| | |
|---|---|
| ***G04B 13/00*** | (2006.01) |
| ***G04B 15/14*** | (2006.01) |
| ***G04B 19/00*** | (2006.01) |
| ***G04B 19/24*** | (2006.01) |
| ***G04B 27/00*** | (2006.01) |
| ***G04B 29/00*** | (2006.01) |
| ***G04B 29/02*** | (2006.01) |
| ***G04B 29/04*** | (2006.01) |
| ***G04B 33/00*** | (2006.01) |

(52) U.S. Cl.
CPC ..... *G04B 19/00* (2013.01); *G04B 19/24* (2013.01); *G04B 27/00* (2013.01); *G04B 29/00* (2013.01); *G04B 29/02* (2013.01); *G04B 29/022* (2013.01); *G04B 29/04* (2013.01); *G04B 33/00* (2013.01)

(58) Field of Classification Search
USPC ..... 368/140, 148, 185, 190, 207, 208
See application file for complete search history.

(56) References Cited

U.S. PATENT DOCUMENTS

| | | | | |
|---|---|---|---|---|
| 4,023,348 | A * | 5/1977 | Giger et al. | 368/88 |
| 2005/0007888 | A1* | 1/2005 | Jolidon | 368/110 |
| 2008/0112273 | A1* | 5/2008 | Pellaton | 368/223 |
| 2010/0080088 | A1 | 4/2010 | Koch | |
| 2010/0135126 | A1* | 6/2010 | Born et al. | 368/74 |
| 2010/0278018 | A1* | 11/2010 | Jouvenot | 368/208 |
| 2011/0038233 | A1* | 2/2011 | Martinez et al. | 368/127 |
| 2011/0110199 | A1* | 5/2011 | Girardin et al. | 368/190 |
| 2012/0092967 | A1* | 4/2012 | Courvoisier et al. | 368/28 |
| 2013/0051190 | A1* | 2/2013 | Villar et al. | 368/132 |

FOREIGN PATENT DOCUMENTS

| | | | |
|---|---|---|---|
| EP | 1 079 284 | A1 | 2/2001 |
| EP | 1 211 578 | A1 | 6/2002 |
| EP | 2 169 479 | A1 | 3/2010 |
| WO | WO 2009/056498 | A1 | 5/2009 |

OTHER PUBLICATIONS

European Search Report dated Aug. 14, 2012 in corresponding European Application No. 11 19 3174 filed on Dec. 13, 2011 (with an English Translation).
U.S. Appl. No. 13/711,125, filed Dec. 11, 2012, Kaelin.

* cited by examiner 10
11
14
15
16
18
20
30
37
39
180
181
182
220
391
392
1000
100
D
1

MODULAR TIMEPIECE MOVEMENT WITH FUNCTIONAL MODULES

This application claims priority from European Patent Application No. 11193174.7 filed Dec. 13, 2011, the entire disclosure of which is incorporated herein by reference.

FIELD OF THE INVENTION

The invention concerns a mechanical timepiece movement in the form of a modular unit.

The invention also concerns a timepiece comprising at least one movement of this type.

The invention concerns the field of mechanical horology and more specifically the field of watches.

BACKGROUND OF THE INVENTION

Modular timepieces are known. Although very widely known in electronic horology, they are less frequent in mechanical horology, where construction in modules, generally devised to break down the same basic movement into several calibres with different functions or having a different presentation, is usually more expensive than the traditional method of manufacture. Only a few additional mechanisms, made on additional plates, are relatively widespread.

Modular construction conventionally imposes the constraint of machining high precision interfaces, because of the accumulation of assembly clearances between modules, which require very tight tolerances for each module, to ensure a satisfactory result for the entire unit.

Manufacture in modules is also very often detrimental to the total thickness of the movement, and it is difficult to make ultra flat or even simply flat movements.

However, modular construction remains an interesting objective for timepiece manufacturers, since it allows assembling tasks to be split. In return for the tighter manufacturing tolerances required by the accumulation of clearances between modules, the final assembly operation can be carried out by less skilled personnel because it is less complicated. However, the final assembly operation still requires the knowledge and sensitivity of a watchmaker.

EP Patent Application No. 1 079 284 in the name of ETA discloses a watch with two main modules each of which contains half of the components.

EP Patent Application No. 0 862 098 in the name of VOSS discloses a modular watch with a timing mechanism forming an entire module.

EP Patent Application No 1 211 578 in the name of ETA discloses an ultra thin electromechanical movement with stacked modules, implementing tubular elements compensating for the variations in thickness of the assembly elements.

EP Patent Application No. 2 169 479 A1 in the name of ETA SA discloses an electronic watch formed of an electronic module and a voltage source connected to each other mechanically and electrically without the use of a printed circuit board to form a compact unit.

WO Patent Application No. 2009/056498 A1 in the name of JOUVENOT FREDERIC discloses an additional self winding mechanism wherein the veil? of the oscillating weight is mounted between the main set of hands on the one hand, and the chronograph and off-centre seconds hands on the other. This additional mechanism is not a module, since it is sandwiched between the components of the main movement, and various arbours and pipes of the movement pass through it.

CH Patent Application No. 647 125 A3 in the name of DUBOIS & DEPRAZ SA discloses a chronograph with a motor module, which includes a first power take-off integral with the cannon-pinion thereof and a second power take-off integral with the seconds arbour. A chronograph module is removably mounted and the gear train thereof is driven by the second power take-off. The two power take-offs are concentric and accessible from the same side of the motor module. The chronograph module is secured between the dial and the top face of the motor module. The hands form part of the chronograph module.

US Patent Application No. 2008/112 273 A1 in the name of PELLATON LOIC (ETA SA) discloses a movement with a fixed support fitted with a display module comprising a central bar secured to the support and an annular display member which rotates freely about the central bar, abutting on the fixed support. The display member has a contact surface. The central bar includes three positioning surfaces formed by three protruding portions cooperating with said contact surface to position the display member axially on the fixed support. The central bar includes three assembling surfaces which are axially and angularly shifted relative to the positioning surfaces. The display member has three lugs. The contact surface, the positioning surfaces, the assembling surfaces and the lugs are arranged to form together a bayonet assembly system for mounting the display member on the bar.

US Patent Application No. 2011/110 199 A1 in the name of GIRARDIN FREDERIC discloses a module for actuating one element of a movement, intended to be mounted on a movement frame. This module contains a mechanism comprising a pivoting control stem moving between axial positions, a control pinion rotatably integral with the control stem, and at least one actuation member arranged to cooperate with the control pinion in one of the axial positions of the stem. The control pinion is integral in translation with the stem when the latter moves from one axial position to another. The module comprises an independent case containing the mechanism, and a connecting means which comes out of the case and is arranged to kinematically connect the actuating member to the element of the movement to be actuated, so that the actuating member can actuate said element regardless of the position of the module on the movement frame.

SUMMARY OF THE INVENTION

The invention proposes to overcome certain prior art problems by proposing a modular unit which can be assembled without using an operator, while ensuring the exactitude of the working parameters with tried and tested adjustments, and with a lower production cost than that of a traditional method of manufacture.

The invention therefore concerns a mechanical timepiece movement in the form of a modular unit, characterized in that it includes at least one mechanical functional module for performing a particular timepiece function, which is irreversibly pre-adjusted by irreversibly securing adjustment and/or assembling components comprised in said functional module after said particular horological function has been adjusted and function checked on the test bench, and in that said at least one pre-adjusted functional module is irreversibly secured to a plate comprised in said movement or comprised in another pre-adjusted functional module of said movement, or is irreversibly secured to another pre-adjusted functional module comprised in said movement.

According to a feature of the invention, each said irreversibly pre-adjusted functional module irreversibly fixed to said plate or to another said pre-adjusted functional module, is a mechanical module.

According to a feature of the invention, said timepiece movement includes a plurality of said functional modules, each pre-adjusted to perform a particular timepiece function, and each mounted, or irreversibly secured, directly or indirectly relative to said plate, or sandwiched between said functional modules and/or components of said movement which are in turn irreversibly secured directly or indirectly relative to said plate.

The invention also concerns a timepiece comprising at least one movement of this type.

BRIEF DESCRIPTION OF THE DRAWINGS

Other features and advantages of the invention will appear upon reading the following detailed description, with reference to the annexed drawings, in which:

FIG. 1 illustrates a gear train module arranged directly on a plate of the movement.

FIG. 2 illustrates the assembly of a functional stem mechanism module, in a preferred embodiment wherein said module performs both the time-setting and manual winding functions, as well, in an optional embodiment, as the date setting function.

FIG. 3 illustrates the locking into position of said stem mechanism module.

FIG. 4 illustrates the assembly of a functional motor module, comprising a complete barrel here.

FIGS. 5 to 8 show the assembly of individually assembled components: barrel arbour, small seconds wheel, barrel drive wheel and frame pillar.

FIG. 9 illustrates the assembly of a frame mounted self winding device module?

FIGS. 10 to 13 show the assembly of individually mounted components: retaining clips for the frame mounted self winding device module, sliding gear return spring, intermediate barrel drive wheel, sliding gear, stop pinion.

FIG. 14 illustrates the assembly of a bar fitted with the self winding device.

FIG. 15 illustrates the assembly of a pre-adjusted functional regulating module, comprising here a sprung balance unit, a pallet lever and an escapement.

FIGS. 16 to 21 illustrate the assembly of a display module, on the opposite side of the plate relative to the side where all the modules and components of FIGS. 1 to 15 were assembled, and after the pre-assembled sub-assembly seen in FIG. 15 has been turned over, with the appropriate components in place: intermediate wheel, cannon-pinion, minute wheel and hour wheel.

FIGS. 22 to 26 illustrate the assembly of an optional date mechanism with the following elements in place: date drive wheel, intermediate date wheel, date corrector wheel, date indicator, date indicator holding plate.

FIGS. 27 and 28 illustrate the assembly of an optional self winding functional module, with a pre-fitted oscillating weight and the screw securing said weight in place.

DETAILED DESCRIPTION OF PREFERRED EMBODIMENTS

Figure 3:
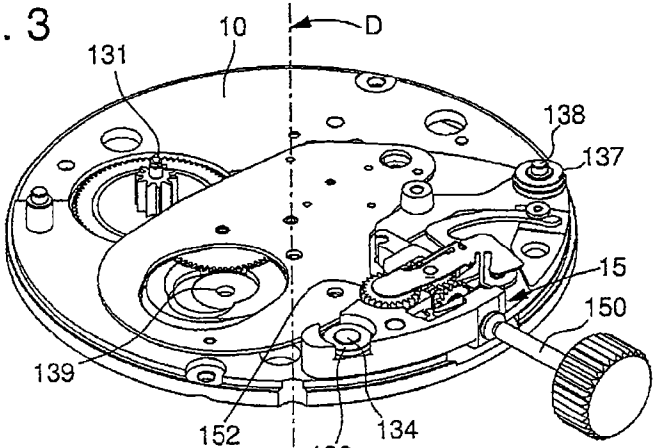
FIGS. 1 to 28 show schematic, perspective views of various successive assembling states of a movement according to the invention, wherein FIGS. 1 to 20 concern a complete basic movement.

The invention concerns the field of mechanical horology and more specifically the field of watches.

The invention concerns a mechanical timepiece movement 100 in the form of a modular unit.

According to the invention, this movement 100 includes at least one mechanical functional module 1 for performing a particular timepiece function which is irreversibly pre-adjusted by the irreversible securing of adjustment and/or assembly components 9 comprised in said functional module 1 after this particular timepiece function has been adjusted and function checked on the test bench.

The composition of movement 100 according to the invention deliberately moves away from traditional timepiece architectures where components are assembled one after the other on a plate, and where the operation of the movement is tested last, which means that all the adjustments are carried out at the end, often involving partial dismantling to carry out the final alteration and then adjustment operations.

The combination of pre-adjusted functional modules 1 is an essential aspect of the invention since each function corresponding to a particular module is therefore tested as early as possible and at lower cost. Adjustments are performed once and for all for each module. Irreversibly securing the adjustment components in each module 1 ensures that the adjustments performed beforehand in each stored module 1 do not deteriorate over time. Management of the final assembly operation is simplified since the final assembly list comprises fewer components.

This at least one pre-adjusted functional module 1 is irreversibly secured, either to a plate 10 of movement 100 or of another pre-adjusted functional module 1 of movement 100, or it is irreversibly secured to another pre-adjusted functional module 1 of movement 100.

Irreversibly securing functional modules 1 to each other or to the same plate 10 also goes against conventional timepiece embodiments. Movement 100 according to the invention is not intended to be removable for after-sales requirements. Indeed, it is irreversibly assembled, which ensures that the adjustments made will last over time, both as regards each of the functional modules and the complete assembled movement 100. The purpose of securing modules 1 is precisely to prevent any loosening and relative movement between components, which often cause failure during use. Thus, the design prevents failures and movement 100 cannot be dismantled once it is completely irreversibly assembled.

In an advantageous embodiment, each irreversibly pre-adjusted functional module secured to plate 10 or to another said pre-adjusted functional module 1 is a mechanical module.

In a preferred embodiment of the invention, seen in the Figures, this timepiece movement 100 includes a plurality of these functional modules 1, each pre-adjusted to perform a particular timepiece function. These functional modules 1 are each mounted, or irreversibly secured, directly or indirectly relative to plate 10, or sandwiched between functional modules 1 and/or components of movement 100, which are in turn irreversibly secured, directly or indirectly relative to plate 10. Naturally, a functional module 1 can be sandwiched between plate 10 and at least one other component or at least one other functional module 1.

Each functional module 1 is a mechanical module derived from a sub-assembly comprising all the components required to perform a particular timepiece function of transforming a movement between at least one input wheel set and at least one output wheel set.

This sub-assembly includes adjustment and/or assembly components which are irreversibly secured after the particular timepiece function peculiar to the functional module concerned has been adjusted and function checked. The individual sub-assembly is adjusted and function checked on the test bench. The actual functional module 1 is thus a pre-adjusted module derived from the transformation of a sub-assembly of this type, by irreversibly securing its adjustment and/or assembly components.

Preferably, each functional module 1 includes at least a first bearing surface, and a locating means for recognising and positioning module 1 relative to another element of movement 100, or relative to plate 10. This positioning is achieved by the abutment of the first bearing surface on a complementary bearing surface comprised in said other element or plate 10. The notion of a "bearing surface" is understood in the broadest sense. A "bearing surface" may equally well be formed by a bore or arbour, or a flat surface or other element.

The locating means may be devised to locate with or without contact, and may take several forms, which may be combined with each other:

in an advantageous variant for automated manufacture, the locating means includes an optical locating means for the optical recognition and positioning of module 1, in another variant, the locating means includes an acoustic or ultrasound locating means for the recognition and positioning of module 1;

in another variant, the locating means includes a mechanical locating means for the mechanical recognition and positioning of module 1, such as lugs, bores, sensors, stop members or suchlike.

The invention is more specifically devised for the automated manufacture of movement 100 and endeavours to allow various modules and components to be set in place in a parallel direction to a single direction of insertion D, selected here to be parallel to the gear train axes with the fewest possible turning over movements or other movements apart from movements of translation.

In a preferred embodiment, the first bearing surface of each functional module 1 is flat and presented perpendicularly to this direction of insertion D.

Preferably, functional module 1 includes at least a second bearing surface parallel to the first bearing surface. This arrangement facilitates automated assembly by paraxial positioning relative to direction of insertion D, with certain components or modules stacked with their bearing surfaces perpendicular to the direction of insertion D in contact with each other?.

To ensure some of the cooperation between assembly components, particularly the gearing between toothed wheels, or between wheels and racks, ratchets or suchlike, or to set in place cams, jumper springs, clicks, fingers, pushers or suchlike, functional module 1 may also advantageously include at least one pivot guide member 8, for pre-assembling the module while allowing it a degree of freedom to pivot. It is therefore possible to ensure this cooperation in a final pivoting movement of module 1. In a preferred but non-limiting embodiment, this pivotal guiding is performed relative to a parallel direction to said direction of insertion D. This is the case of adjusting module 16 in the movement set out in detail below.

In a variant, module 1 includes a guide means arranged to cooperate with a complementary guide means comprised in another module 1, or a component of movement 100 or plate 10, to achieve a similar cooperation by translation, or a parallel adjustment, in one plane like a slide or drawer. Preferably, these guide means are made in a perpendicular direction to direction of insertion D.

The Figures illustrate a movement 100, the composition of which includes functional modules 1 of this type and isolated components which combine to form functional sub-assemblies. The reduction in the number of objects to be handled during assembly of the movement, and especially the reduction or disappearance of any adjustment operations, are made possible by the concept of pre-adjusted functional units. It will be noted that, although some components are mounted here in isolation, this is essentially for the purpose of reducing or limiting the thickness of the movement, since it is also possible to secure these components, which participate in the same kinematic chain of one functional sub-assembly, to an additional plate, but this would then have a detrimental effect on the total thickness of the movement.

The movement described below requires only 21 objects to be handled in the basic version (a movement with no mechanically wound date mechanism), namely 5 pre-adjusted modules and 16 isolated or pre-assembled components (for example arbours and wheels). All the movements made during assembly are translations parallel to each other, and only one pivoting motion is required to mesh a regulating module. Assembling the date mechanism requires 5 additional components to be set in place, whereas assembling the self-winding mechanism requires only 2 components to be set in place, i.e. a module and a screw.

The gearing cooperation can be achieved either with complementary guide tools, or by pivoting the head of the handling system.

In a preferred implementation, the assembly is carried out a by a robot controlled by a control means which cooperates with a shape recognition means, particularly a mechanical and/or optical means, which identifies the shape and position of locating means peculiar to modules 1 and/or the retail components.

There are 6 functional modules used here, one of which is a double module in the particular non-limiting case illustrated by the Figures which forms both a gear train module and a display module.

A first type of functional module 1 is a motor module 11 and it is a complete barrel which comprises at least one barrel 110, whose input wheel set is formed by a barrel arbour 111, which cooperates with a ratchet 12, which may or may not be incorporated in said motor module 11, and which is arranged to be pivoted, either by a manual winding mechanism or by a winding and time-setting mechanism 15, or by a self-winding mechanism or by a self-winding module 18, to wind at least one spring (not shown in the Figures) in at least one drum 113 forming the output wheel set of said motor module 11. This drum 113 is arranged for driving an input pinion 131 of a gear train or a gear train module 13.

Another type of functional module 1 is a gear train module 13, the input wheel set of which is formed by an input pinion 131, arranged to cooperate with a drum 113, and a first output wheel set of which is formed by a fourth wheel arranged to cooperate with an escape pinion connected to an escape wheel comprised in an escape mechanism or a regulating module 16.

Advantageously, this gear train module 13 includes a second output wheel set which is formed by a display train arranged to cooperate, either with display means comprised in the gear train module 13, or with a display module 14 external to gear train module 13, or carried by the same plate, and comprising display means.

This display module 14 has an input wheel set formed by a display train comprised in a gear train mechanism or gear train module 13 and an output wheel set formed by at least one indicator arranged to cooperate with a complementary indicator or with a dial comprised either in display module 14 or movement 100 or a timepiece 1000 incorporating said movement.

Advantageously, this gear train module 13 or display module 14 includes a motion work mechanism, which is friction connected to the gear train disclosed in EP Patent Application No. 11177840 by the same Applicant, and includes a fourth wheel set pre-assembled on a centre tube, which is the subject of EP Patent Application No. 11177839 by the same Applicant.

Yet another type of functional module 1 is a time-setting module 15, the input wheel set of which is formed by a stem 150 arranged to be moved by a user, and a first input wheel set of which is formed by a motion work control train 151.

Preferably, this time-setting module 15 is also a time-setting and winding module, and includes a second output wheel set which is formed by a winding control train 152.

Advantageously, this module 15 is made with a winding stem mechanism according to EP Patent Application No. 11170180 by the same Applicant. It may also integrate a device for manual winding via pressure on the stem according to EP Patent Application No. 11177838 by the same Applicant.

In a particular embodiment, this module 15 is based on a bridge made of plastic material, preferably highly resistant charged plastic, for example 30% or 40% polyphenylene sulfide (PPS), or a polyamide such as polylauromide (PA 12), and with a maximum thickness of close to 2.5 mm, the choice of these materials ensuring that good rigidity is maintained even with large section differences in said bridge 156.

Yet another type of functional module 1 is a regulating module 16 comprising a regulating unit, and the input wheel set thereof is formed by an escape wheel arranged to be moved by a fourth wheel comprised in a gear train or gear train module 13, and the output wheel set of which is formed by said same escape wheel.

This platform escapement regulating module 16 is advantageously made in accordance with the characteristics of EP Patent Application Nos. 11005713 and 11179181 by the same Applicant, and includes a sprung balance assembly, an escapement and a particular pallet lever.

A particular functional module 1 is a self-winding module 18, the input wheel set of which his formed by an oscillating weight 180 moved by the motions of a user or an external tool, and the output wheel set of which is formed by a drive train of a ratchet 12 comprised either in a motor mechanism, or a motor module 11, or a ratchet 12 which meshes with a barrel arbour comprised either in a motor mechanism or a motor module 11.

This oscillating weight 180 is advantageously made in accordance with the characteristics of EP Patent Application No. 11188261 by the same Applicant.

FIGS. 1 to 28 illustrate the composition and assembly of a timepiece movement 100 forming a modular unit according to the invention, in a preferred and non-limiting sequence of operations to position and secure the various modules and components forming the movement.

According to the invention, all the modules and components which form movement 100 can be inserted in a parallel direction to a direction of insertion D, which is parallel to the axes of the gear train here.

In a preferred and non-limiting embodiment of the invention, each sub-assembly formed of an assembly of plates, bars and pre-adjusted functional modules 1 according to the invention, is irreversibly fixed as soon as each additional single piece module is set in place.

Figure 1:
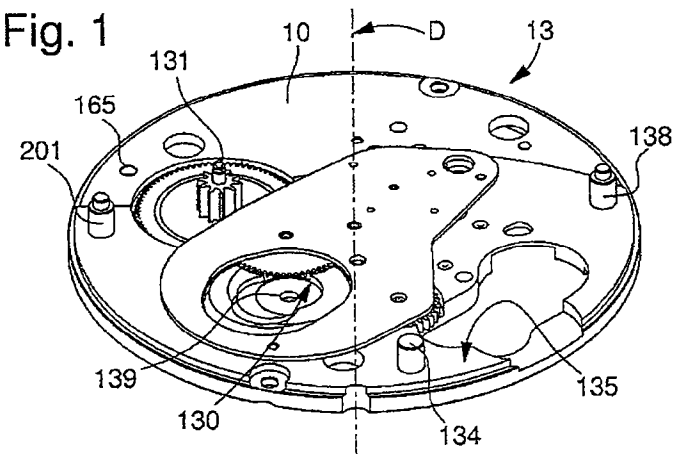

FIG. 1 illustrates an assembled equipped (?) plate, which forms a base on which various modules and components are assembled. A gear train module 13 is arranged here directly on a plate 10 of movement 100, so as to save thickness. In an alternative embodiment, not illustrated in the Figures, gear train module 13 includes another plate, which can be affixed to the main plate 10 during assembly.

In this embodiment, this same plate 10 carries a display module 14 as described above.

Plate 10 has a bearing surface 135 for receiving a time-setting module 15 and a pivot 134 for cooperating with said module.

Two shouldered studs 201 and 138 are mounted to cooperate with an assembled self-winding device frame 20?

The gear train is not detailed here. FIG. 1 shows an input pinion 131 which is a centre wheel pinion.

Counter-bores 130 are arranged around a centring bore 139, intended to receive a barrel arbour, to prevent a collision with a complete barrel, forming a motor module 11, during assembly.

Plate 10 further includes a bore 165 for receiving an arbour 162 of a regulating module 16.

Figure 2:
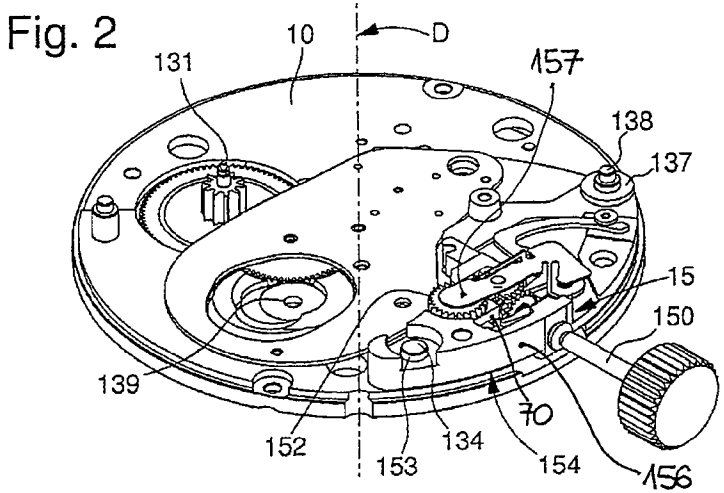

FIG. 2 shows the assembly of a stem mechanism module 15, more specifically a time-setting module, on said plate 10, via a bore 153 of module 15 engaged on pivot 134, and a bearing surface 154 of module 15 abutting on bearing surface 135 of plate 10. This module 15 includes a stem 150 connected to a crown to allow the user to adjust the time of the movement. The first output wheel set is formed by a motion work control train 151. In a preferred embodiment illustrated in the Figures here, this module 15 also performs the function of a manual winding module and the second output wheel set is formed by a winding control train 152. The user pulls on stem 150 in a conventional manner to select the chosen function.

This stem mechanism module 15 is devised for robotic assembly and testing. Studs are driven onto a bridge 156 and advantageously pass through said bridge 156 and project from both sides thereof. Wheels, levers, the sliding gear and pull-out piece are mounted on said studs; and an optical check with a camera is performed on a first part of the train, comprising in particular a sliding gear for selecting between two wheels, one controlling the time-setting function and the other the winding function, before said first part of the train is permanently confined by a holding plate 157, preferably achieved by laser welding the covering plate, at several points, either just below the surface at the end of the studs acting as pivot arbours, or through the covering plate. This irreversible assembly means that the assembly can be turned over by a manipulator in complete safety in order to assemble components on the other side, which is checked by a camera, before the lever holding plate is set in place, welded in several places. The kinematic chain starting from stem 150 is then completed, and a mechanical function check is performed in the three positions T1, T2, T3 of the stem, in both directions of rotation. As disclosed in EP Patent Application No. 11170180 cited above, module 15 advantageously comprises a pivoting lever 70 for holding the stem. The operation of said lever is mechanically tested by provisionally pulling out the stem, but this is saved until the final assembling of the movement.

Movement 100 comprising these functional modules 1 is assembled in accordance with the same principle. Thus, the assembling of some components of the movement includes similar test and irreversible securing steps prior to use. This is particularly the case of the assembling of the gear train on plate 10, which, once irreversibly fixed by welding, forms a gear train module.

The automated assembly of the gear train starts with preparation of plate 10 by the etching, preferably laser etching, therein of the identifying marks required for after-sales service, anti-counterfeiting marks, and the traceable manufacturing code of the movement. A centre tube is prepared on a specific stand, the plate is placed and driven onto a shoulder of said centre tube and riveted thereto; a fourth arbour is prepared on a stand, the preceding sub-assembly is placed on the fourth arbour, and the pinion is then placed on the top and driven onto the fourth arbour to secure it. The centre wheel is then positioned, the combination of a camera, a rotating manipulator and a positioning robot then enables the third wheel to be positioned and a similar handling operation is performed to position the intermediate plate and any other wheels in the correct gearing. A holding plate for said gear train is then welded in several places. Any necessary oiling is carried out during the assembly process in accordance with specific manufacturing rules, and in sufficient quantity to allow a mechanical function test of the gear train to be carried out by mechanical and/or fluid driving.

FIG. 3 shows stem mechanism module 15, after being positioned on the gear train module formed by assembling the plate and gear train, being locked by two rings 136 and 137 respectively driven onto staged studs 134 and 138 of plate 10. Driving in the rings enables the sub-assembly to be handled safely.

Figure 4:
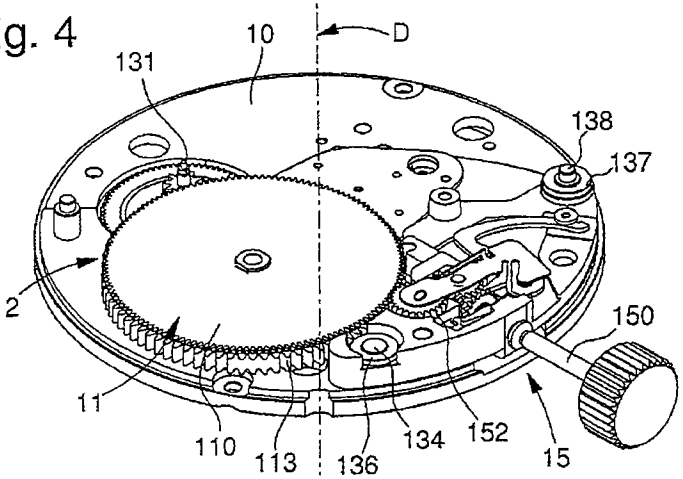

FIG. 4 shows the assembly of a motor module 11 of the type described above. Barrel 113 is first of all meshed with pinion 131 of the third wheel using an assembly tool. The barrel is then pivoted on a gyration radius concentric to the position of the centre wheel, so as to bring module 11 with ratchet-cover 12 into mesh with intermediate wheel 152 of the winding train of stem mechanism module 15.

This positioning of the barrel requires a movement of translation so as to allow proper gearing, both at the top part thereof and the bottom part thereof (ratchet and drum). Indeed, in the preferred embodiment illustrated in the Figures, the barrel is not guided into a recess but simply placed on a flat surface, formed here by the holding plate of the gear train, as seen in FIGS. 1 to 3. This positioning operation by a movement of translation is specific to the invention, due to the absence of a pivot at this assembly stage.

Figure 5:
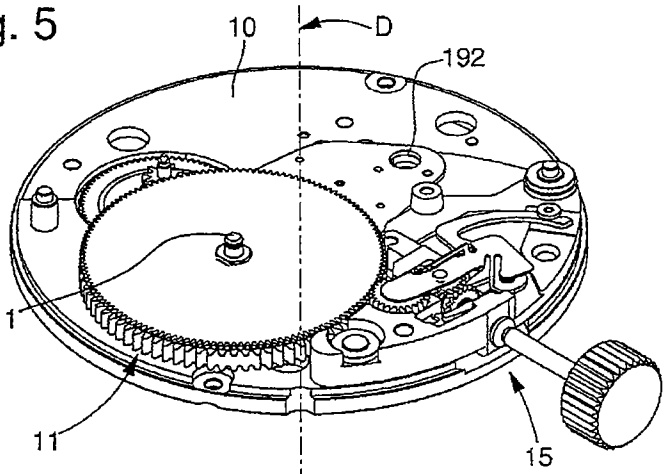
Figure 6:
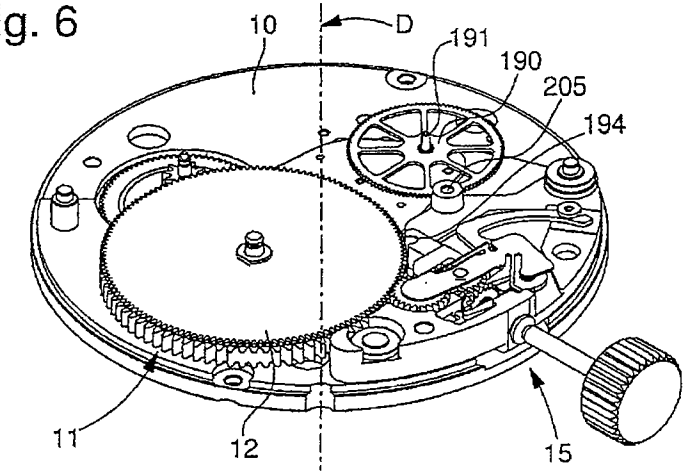

FIG. 5 illustrates the barrel arbour 11 being assembled from below in bore 139 of plate 10. In a preferred embodiment, this barrel arbour has a shouldered head like a nail, which is mounted here underneath plate 10, on the side intended to receive the dial, which is not visible in FIG. 5. This barrel arbour 111 is fitted into a bore of a core of barrel 113 onto which the barrel spring is hooked, and which includes a first shoulder cooperating with a bore of the drum, and a second shoulder, which cooperates with the ratchet-cover 12.

Plate 10 further includes a bore 192 for the assembly (illustrated in FIG. 6) of an arbour 191 of a small seconds wheel 190.

Figure 12:
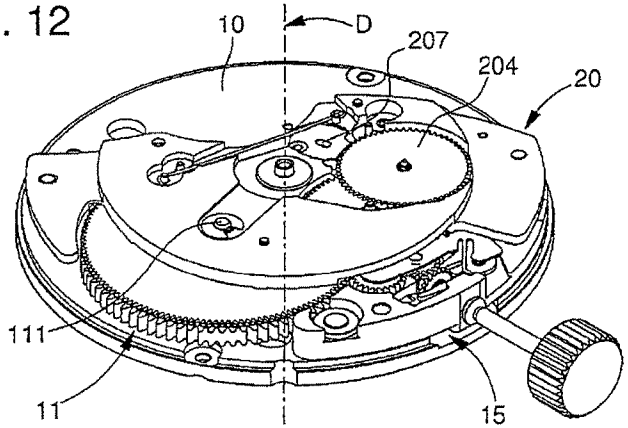

In proximity to said small seconds wheel 190, a guide member 205 is provided for receiving a barrel drive wheel 204, the assembly of which is shown in FIG. 12.

Figure 7:
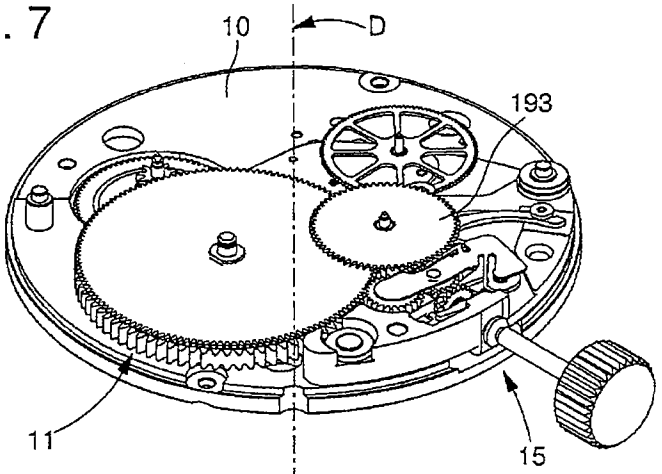

In proximity to drum 113, a guide member 194 is provided for receiving a barrel drive wheel 193, the assembly of which is seen in FIG. 7. Indeed, said wheel 193 is a plate which provided with a very long arbour and is difficult to position, thus advantageously an abutment guide member 194 is arranged on bridge 156 of module 15. The contact points are oiled prior to an optical check.

Figure 15:
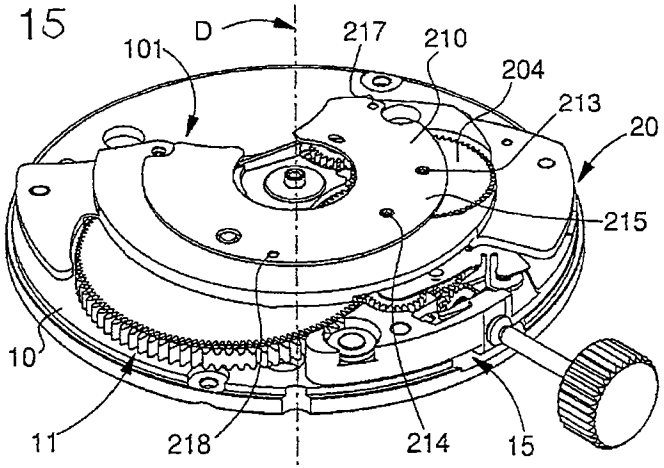

During assembly, this guide member 194 holds said wheel 193 in a vertical position until the subsequent assembling of a bar 200 called a self winding bar of a frame mounted self-winding device 20 and then a flange 215 comprising a jewel 213 for the top guiding thereof, as seen in FIG. 15.

Figure 8:
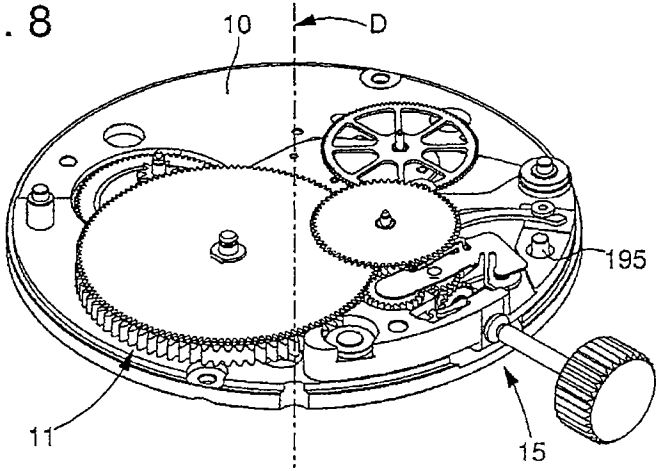

FIG. 8 shows the assembly of a pillar 195 for a frame mounted self-winding device 20, said pillar being secured, not to plate 10, but in a bore of a bar comprised in module 15. This pillar 195 ensures the spacing between the various bars, and the washers have only a gripping function, indeed there is play between the mechanical frame and the bar 156 of module 15.

In a variant, a closing plate is positioned after the optical check and the assembly is secured by welds on the studs.

Figure 9:
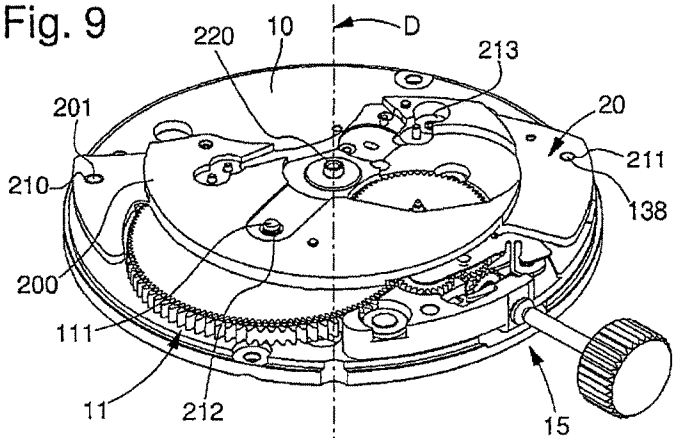

FIG. 9 shows the assembling of frame mounted self-winding device 20, which comprises a self-winding bar 200 for optionally receiving a self-winding module 18. This bar 200 has two bores 210 and 211 for cooperating with the ends of shouldered studs 201 and 138 driven into plate 10. It also includes a bore 212 for guiding barrel arbour 111 and a jewel 213 for guiding the arbour of the small seconds wheel 191. Bar 200 also includes a guide member 220 for an oscillating weight 180.

This bar 200 may be directly welded to plate 10 thereby sandwiching the already assembled components, or welded at the ends of studs 201 and 138 or suchlike.

Figure 10:
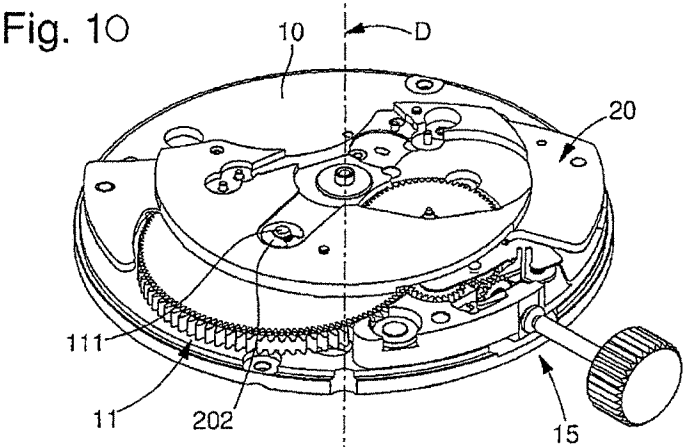

FIG. 10 illustrates the assembly of a retaining means, formed here by clips 202 or by a key or similar element, for retaining the bar of the self-winding device in the event of a shock applied to movement 100 and especially for holding barrel drive wheel 193. In fact, the strong inertia of optional oscillating weight 180, which pivots in guide member 220 of bar 200, may, in the event of a shock, have the effect of applying a traction stress on the median part of frame 20.

Figure 11:
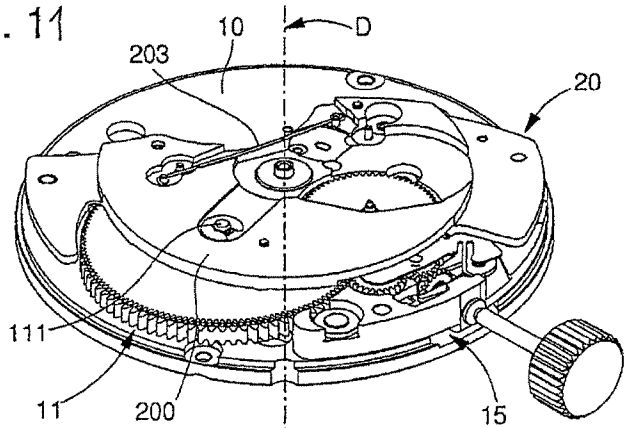

A sliding gear return spring 203 is then mounted in abutment on raised portions of bar 200, as seen in FIG. 11. This difficult assembly is carried out prior to an optical check, following which the self-winding bar 200 is assembled, the barrel arbour (which was free until this stage of assembly) is advantageously welded at this assembly stage.

Figures 25, 26, 27, 28, 29:
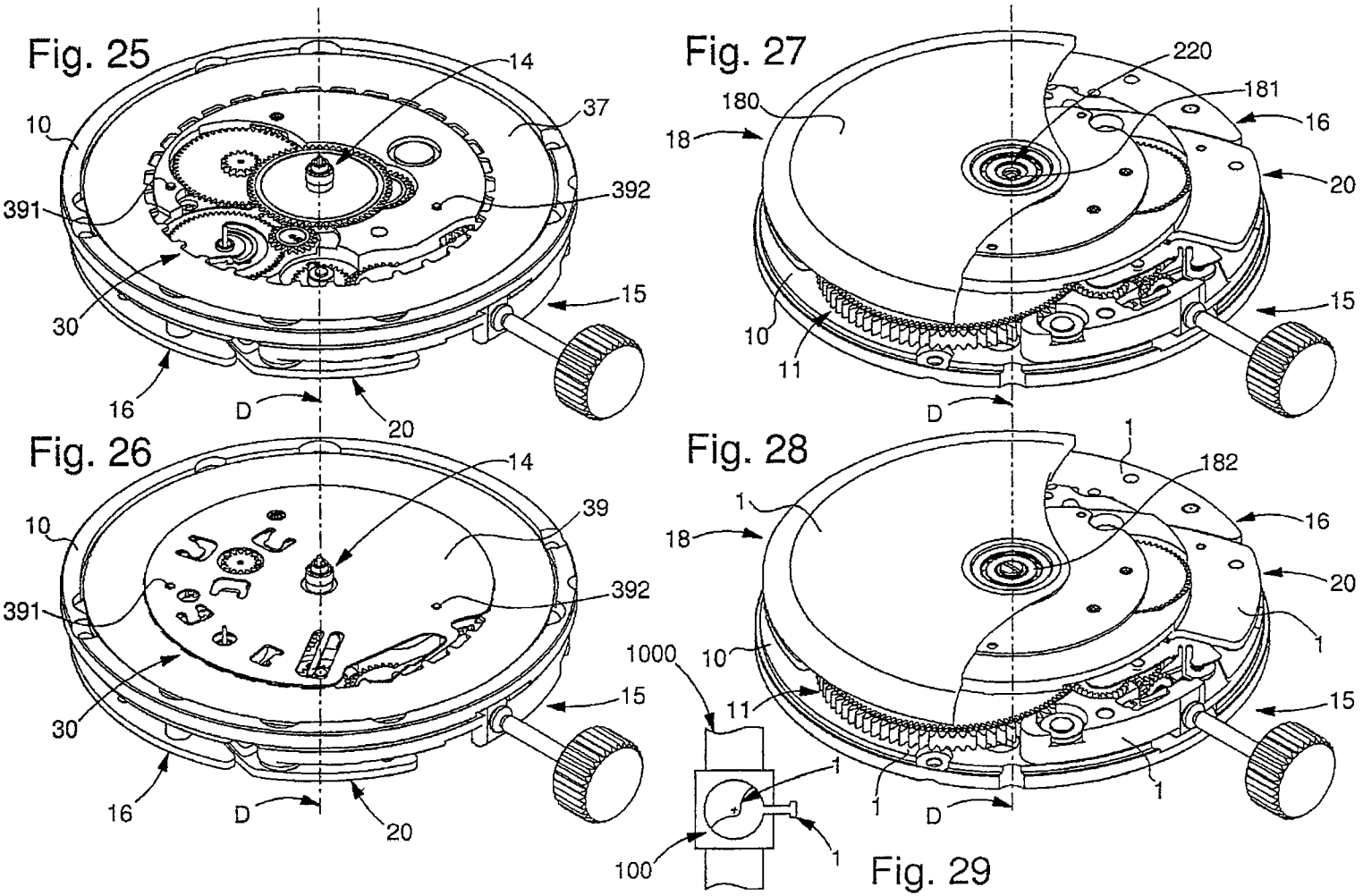
FIG. 29 shows a schematic view of a timepiece including a movement of this type fitted with several functional modules.

An optional self-winding module 18 can be mounted at this stage, or later in the assembly sequence. FIGS. 26 and 27 illustrate the assembly of a self-winding module 18 with an oscillating weight 180. A guide member 181 for oscillating weight 180 cooperates with a guide member 220 comprised in frame mounted self winding device 20. Finally, a securing screw 182 is set in place in FIG. 27. The free rotating function of oscillating weight 180 clockwise and anti-clockwise is then tested by a robotic manipulator. As the sub-assembly has to be turned over for the final assembling of the motion work, it is possible either to postpone the assembly of oscillating weight 180 for as long as possible in the assembly sequence, to avoid the requirement for it to be held during subsequent handling operations, or to dismantle oscillating weight 180 after it has been function checked.

Figure 13:
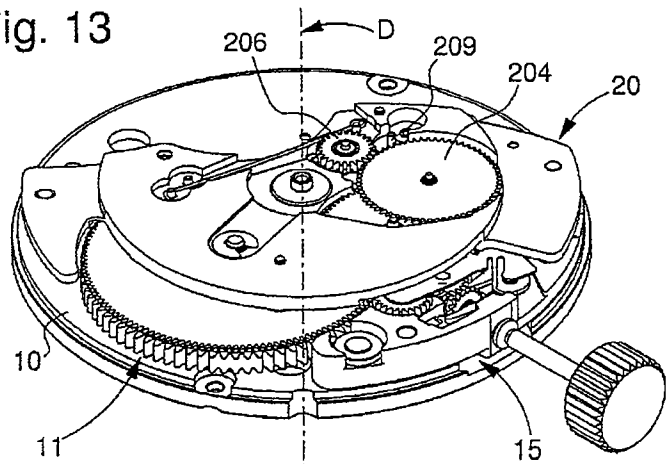
Figure 14:
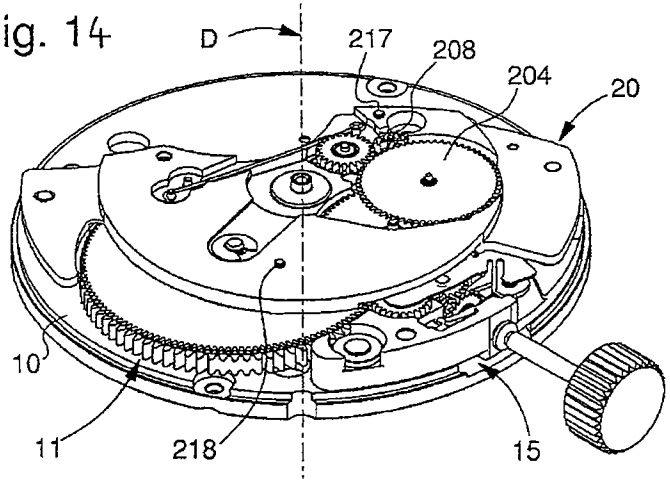
Figure 16:
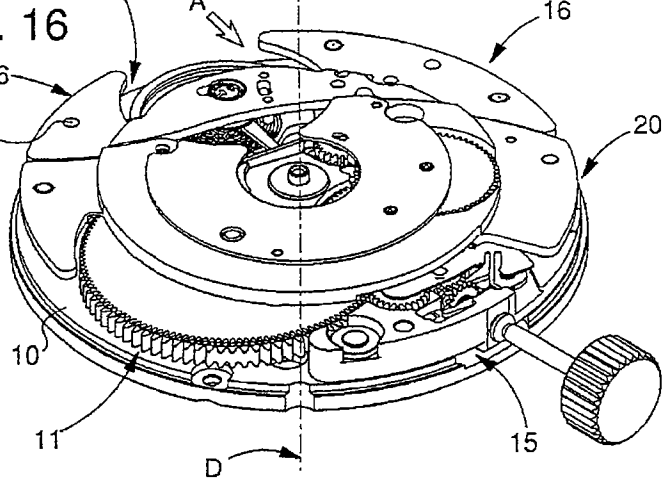

FIG. 12 then shows the assembly of intermediate barrel drive wheel 204 in its guide member 205. The figure shows an oblong hole 207 arranged in bar 200 for receiving the arbour of a sliding gear 206, the assembly of which is shown in FIG. 13. The neighbouring guide stud 209 is used as a pivot for a stop pinion 208, the assembly of which is shown in FIG. 14.

Two centring studs 216 and 217 position a flange 215, which includes jewels 213 and 214 for guiding the barrel drive intermediate wheel 204 and barrel drive wheel 193, and a top oblong hole 218 for guiding sliding gear 206.

At this stage, the sub-assembly thereby formed is ready to receive a regulating module 16, preferably carrying a sprung balance and the escapement, as explained above. This regulating module 16 advantageously includes, for the external securing of the balance spring, a stud bonded to a bar, the width of said stud being sufficient to all it to be identified until said stud is permanently bonded. Advantageously, this regulating module 16 includes a balance with a small mould casted roller according to EP Patent Application No. 11194061.5 by the same Applicant.

This regulating module 16 includes a stud 162 arranged to cooperate with bore 165 of the plate. It is easy to pre-position regulating module 16 by inserting it in the direction of insertion D, in abutment on plate 10 via a bottom bearing surface 101, in an angular orientation wherein the module projects outside plate 10. A pivoting motion in direction A allows said module to cooperate with the rest of the movement, as explained in EP Patent Application No. 11005713 by the same Applicant, in the position illustrated in FIG. 16. The assembly of this regulating module 16 includes optical camera checks, and inter-axe and distance measurements, before the module is permanently adjusted and secured. A clamp type gripping means allowing said regulating module 16 to be held in place so that it can be turned over for several weld spots to be made on the side which is not visible to the watch user.

At this stage, the manual winding movement can function, and the unit formed can be handled in any position without the loss or movement of any components. Winding using the stem is tested with a high rotational speed of around 100 turns per minute, simulating human handling of the crown.

As described above, the various modules are thus permanently welded in around forty places distributed over several welding stations.

Figure 17:
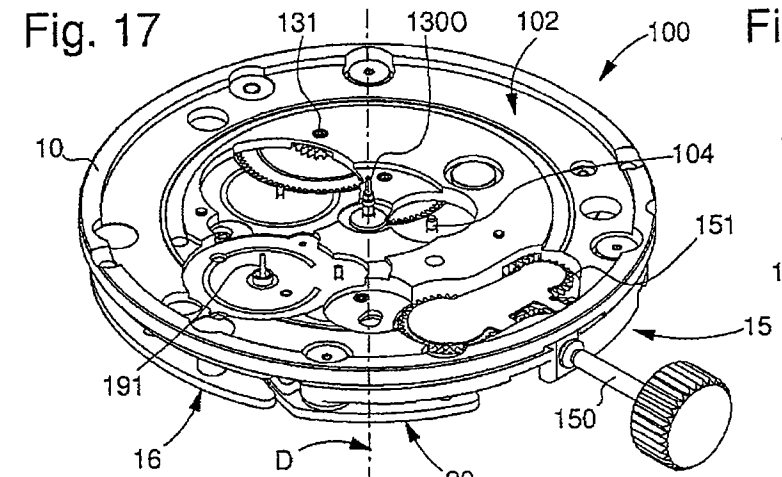

FIG. 17 shows the pre-assembled movement 100 being turned over. Plate 10 has a surface 102 that can act as support, as appropriate, for a dial or a date disc or similar.

The stem mechanism module 15 controls the motion work control train 151, which meshes with the motion work.

The display is assembled last.

The fourth wheel arbour 1300 is at the centre of movement 100 here. The arbour 191 of the small seconds wheel and centre wheel arbour 131 are visible. They are preferably all pre-assembled before? the stage of display module 14 which is formed on the back of plate 10, while gear train module 13 is essentially mounted on the front side of said plate 10. The unit forms a single basic structural module here, but could also be split into two independent modules.

Figure 18:
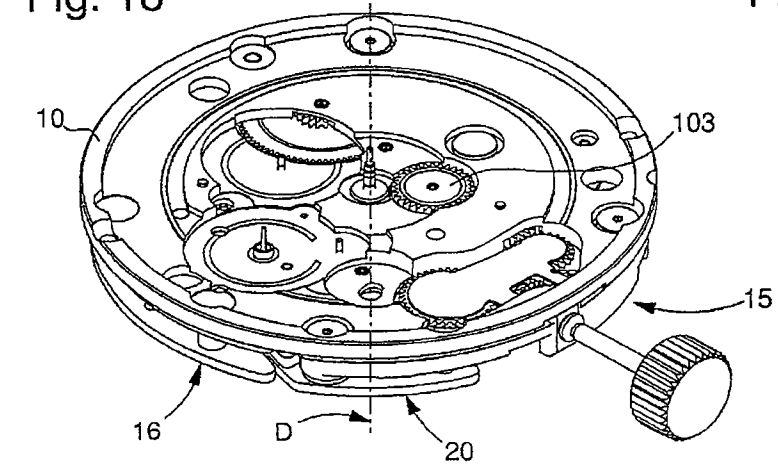

In FIG. 18, a stud 104 driven into plate 10 receives an intermediate wheel 103.

Figure 19:
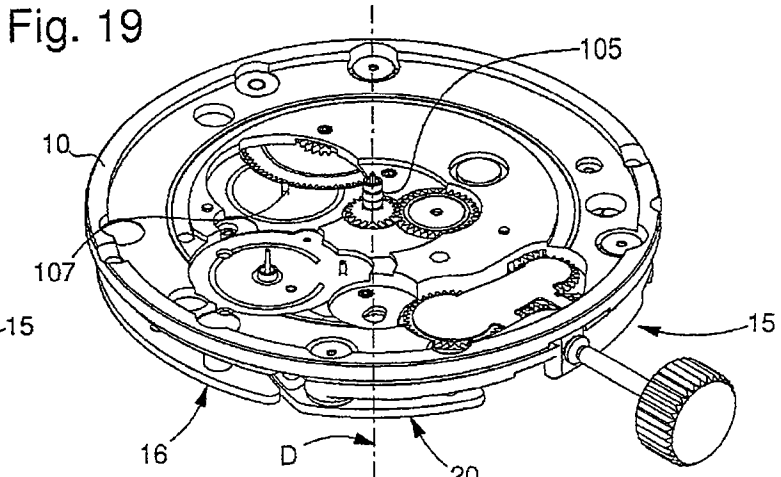
Figure 20:
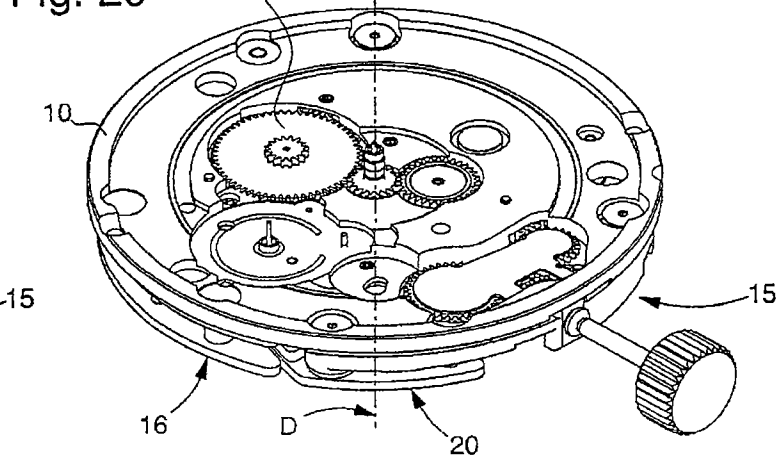

The cannon-pinion 105 is set in place and meshed in FIG. 19. Then the minute wheel 106 is set in place in FIG. 20, on a stud 107 driven into plate 10.

Figure 21:
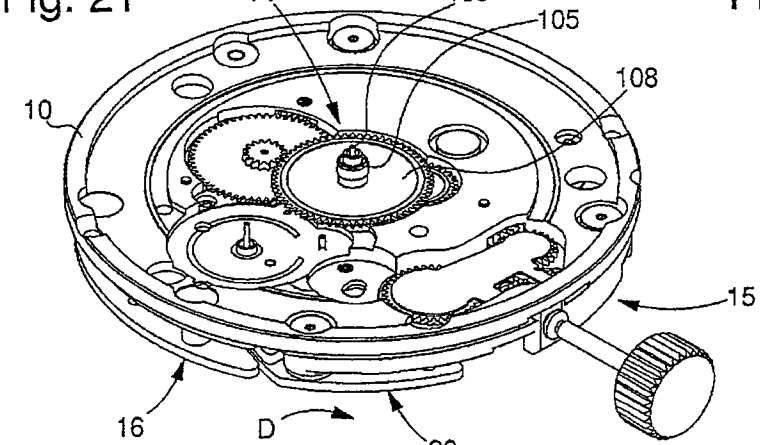
Figure 24:
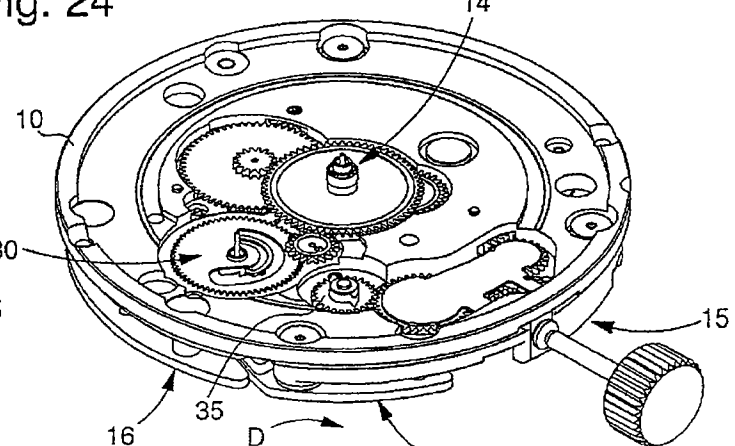

FIG. 21 shows the assembly of hour wheel 108.

At this stage, movement 100 can be closed, on the motion work side, by a holding plate or dial, not shown in the Figures, and the movement is completely operational as soon as the hands have been assembled.

Figure 23:
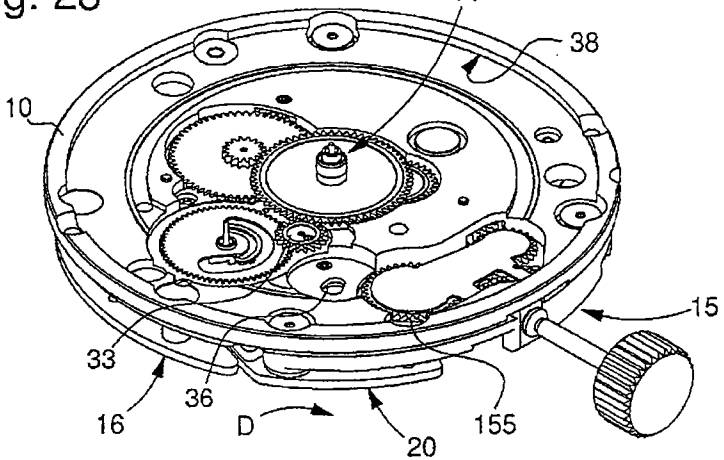
Figure 22:
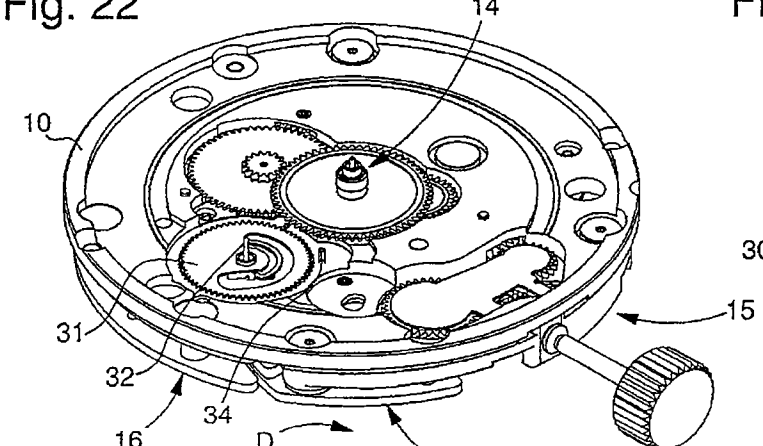

In a non-limiting variant illustrated in FIGS. 21 to 25, movement 100 is also fitted with a date mechanism 30. FIG. 22 shows the assembly of a date drive wheel 31. FIG. 23 shows the assembly of an intermediate date wheel 33, pivoting on a stud 34 driven into plate 10, and FIG. 34 shows the assembly of a date corrector wheel 35, in mesh with a date control train 155 comprised in the stem mechanism module 15. The gearing is then optically checked. A ring or disc shaped date indicator 37 is placed in abutment on surface 102 as seen in FIG. 25, a holding plate 39 for the date indicator is then assembled in FIG. 26, centred by studs 391 and 392 driven into plate 10. The spring is simultaneously assembled by the robotic manipulator. Welding is then carried out in several places prior to a function test of the control of the date by the stem.

Preferably, movement 100 is completely wound before the date mechanism is set in place, in order to test that regulating and escape module 16 is properly positioned, and to perform a lapping operation, particularly of 48 hours, before the final rate adjustment is carried out by mechanical action on the balance to adjust inertia and/or unbalance immediately in the assembled movement 100. In any event, prior winding of stem 150 is required for the date mechanism test.

Self winding movement 100 is then completely assembled and ready to operate.

In a particular preferred embodiment, movement 100 does not contain an index-assembly where the balance spring is secured. Indeed, adjusting the rate by direct mechanical action on the balance means that this mechanism is no longer required. Consequently, no shock absorber is required to hold a non-existent index-assembly, which allows greater freedom as regards the design of the damping means.

Advantageously, movement 100 includes top and bottom cylindrical shock absorbers which are simple, inexpensive and compact.

In an advantageous variant, a functional module 1 includes a support made of highly resistant charged plastic material, for example PPS 30 or PPS 40 or similar, in order to withstand the high traction stresses which may be exerted on certain arbours. To answer the same resistance requirement, the functional module components are mounted on through-hole metal pins driven into the support, rather than studs moulded with the support, whose shearing resistance might be insufficient. These components are then immobilised, on a first side, by a weld on a first end of said pins. The advantage of using this type of support is the accessibility from both sides for assembling components. During automated assembly, it is possible to turn over the support at an intermediate assembly stage, after the components have been assembled on one side, and it is then easy to mount the components on the second side and immobilise them by welding the second end of each pin. Naturally, it is then possible to turn over the support as many times as desired since there is no risk of losing any components.

It is clear that the modular configuration according to the invention specifically allows two sided accessibility relative to an intermediate support, which is not possible in a conventional assembly where all the components are mounted on the same side of a plate, which cannot be turned over as work is carried out. It can even be said that the modular configuration is mandatory in order for this assembly and double sided welding to be carried out.

In a preferred variant, movement 100 includes a maximum of one screw, on the oscillating weight, if the movement has one. All the other connections are achieved without using screws.

In a particular variant without an oscillating weight, movement 100 has no screws at all.

Limiting the number of screws or omitting screws is an important factor in preventing maladjustment or failure.

The invention also concerns a timepiece 1000 including at least one such movement 100.

The invention also optimises the internal volume of the movement, by allowing flat movements to be made, which was not possible in prior art embodiments comprising additional mechanisms each comprising a plate stacked on other plates and onto the bottom plate.

The invention has the advantage of combining, within one movement which forms a modular unit of this type, functional modules, which have each been pre-adjusted and pre-tested, and which do not require any subsequent adjustment during the final assembly of the movement. The reliability of a movement of this type is therefore very good.

What is claimed is:

1. A mechanical timepiece movement in the form of a modular unit, wherein said movement includes a plurality of mechanical functional modules each performing a particular timepiece function, said functional modules being irreversibly adjusted prior to securing of adjustment and assembly components comprised in said functional modules, wherein no further adjustment of said functional modules is possible after said adjustment and assembly components are irremovably secured such that said functional modules cannot be dismantled from said movement, wherein each of said adjusted functional modules is irremovably secured to a plate comprised in said movement or comprised in another adjusted functional module of said movement, or is irremovably secured to another adjusted functional module comprised in said movement, and wherein at least one of said adjusted functional modules is irremovably secured to a front of the plate and at least one of said adjusted functional modules is irremovably secured to a back of the plate.

2. The timepiece movement according to claim 1, wherein said functional modules are each irremovably secured, directly or indirectly relative to said plate, or sandwiched between functional modules or components of said movement which are in turn irremovably secured directly or indirectly relative to said plate.

3. The timepiece movement according to claim 1, wherein each of said adjusted functional modules is derived from a sub-assembly comprising all the components required to perform a particular timepiece function of transforming a movement between at least one input wheel set and at least one output wheel set.

4. The timepiece movement according to claim 3, wherein said movement includes at least one of said adjusted functional modules which is a motor module and includes at least one barrel and the input wheel set of which is formed by a barrel arbour, which cooperates with a ratchet arranged to be pivoted, either by a manual winding mechanism or by a winding and time-setting mechanism or by a self winding mechanism or by a self winding module to wind at least one spring in at least one drum forming said output wheel set of said motor module, said drum being arranged to drive an input pinion of a gear train or gear train module.

5. The timepiece movement according to claim 3, wherein said movement includes at least one of said adjusted functional modules which is a gear train module, the input wheel set of which is formed by an input pinion arranged to cooperate with a drum, and a first output wheel set of which is formed by a fourth wheel arranged to cooperate with an escape pinion connected to an escape wheel comprised in an escape mechanism or a regulating module.

6. The timepiece movement according to claim 5, wherein said movement includes a second output wheel set which is formed by a display train arranged to cooperate, either with a display mechanism comprised in said gear train module, or with a display module external to said gear train module.

7. The timepiece movement according to claim 3, wherein said movement includes at least one of said adjusted functional modules which is a display module, the input wheel set of which is formed by a display train comprised in a gear train mechanism or a gear train module and the output wheel set of which is formed by at least one indicator arranged to cooperate with a complementary indicator or with a dial comprised either in said display module or a timepiece incorporating said module.

8. The timepiece movement according to claim 3, wherein said movement includes at least one of said adjusted functional modules which is a time-setting module, the input wheel set of which is formed by a stem arranged to be moved by a user, and a first input wheel set of which is formed by a motion work control train.

9. The timepiece movement according to claim 8, wherein said time-setting module is a time-setting and winding module and includes a second output wheel set which is formed by a winding control train.

10. The timepiece movement according to claim 3, wherein said movement includes at least one of said adjusted functional modules which is a regulating module comprising an adjustment unit, and the input wheel set of which is formed by an escape wheel arranged to be moved by a fourth wheel comprised in a gear train or gear train module, and the output wheel set of which is formed by said same escape wheel.

11. The timepiece movement according to claim 3, wherein said movement includes at least one of said adjusted functional modules which is a self-winding module, the input wheel set of which is formed by an oscillating weight moved by the motions of a user or an external tool, and the output wheel set of which is formed by a drive train of a ratchet comprised either in a motor mechanism, or a motor module, or a ratchet which meshes with a barrel arbour comprised either in a motor mechanism or a motor module.

12. A timepiece including at least one movement according to claim 1.

13. The timepiece movement according to claim 1, wherein the movement comprises a balance spring that is not secured to an index assembly.

14. The timepiece movement according to claim 1, wherein the movement comprises a pin driven through both sides of the plate where both ends of the driven-in pin are welded to mechanical functional modules.

15. A mechanical timepiece movement in the form of a modular unit, wherein said movement includes a plurality of mechanical functional modules each performing a particular timepiece function, said functional modules being irreversibly adjusted prior to securing of adjustment or assembly components comprised in said functional modules, wherein no further adjustment of said functional modules is possible after said adjustment or assembly components are irremovably secured such that said functional modules cannot be dismantled from said movement, wherein each of said adjusted functional modules is irremovably secured to a plate comprised in said movement or comprised in another adjusted functional module of said movement, and is irremovably secured to another adjusted functional module comprised in said movement, and wherein at least one of said adjusted functional modules is irremovably secured to a front of the plate and at least one of said adjusted functional modules is irremovably secured to a back of the plate.

16. The timepiece movement according to claim 15, wherein said functional modules are each irremovably secured, directly or indirectly relative to said plate, or sandwiched between functional modules or components of said movement which are in turn irremovably secured directly or indirectly relative to said plate.

17. The timepiece movement according to claim 15, wherein each of said adjusted functional modules is derived from a sub-assembly comprising all the components required to perform a particular timepiece function of transforming a movement between at least one input wheel set and at least one output wheel set.

18. The timepiece movement according to claim 17, wherein said movement includes at least one of said adjusted functional modules which is a motor module and includes at least one barrel and the input wheel set of which is formed by a barrel arbour, which cooperates with a ratchet arranged to be pivoted, either by a manual winding mechanism or by a winding and time-setting mechanism or by a self winding mechanism or by a self winding module to wind at least one spring in at least one drum forming said output wheel set of said motor module, said drum being arranged to drive an input pinion of a gear train or gear train module.

19. The timepiece movement according to claim 17, wherein said movement includes at least one of said adjusted functional modules which is a gear train module, the input wheel set of which is formed by an input pinion arranged to cooperate with a drum, and a first output wheel set of which is formed by a fourth wheel arranged to cooperate with an escape pinion connected to an escape wheel comprised in an escape mechanism or a regulating module.

20. The timepiece movement according to claim 19, wherein said movement includes a second output wheel set which is formed by a display train arranged to cooperate, either with a display mechanism comprised in said gear train module, or with a display module external to said gear train module.

21. The timepiece movement according to claim 17, wherein said movement includes at least one of said adjusted functional modules which is a display module, the input wheel set of which is formed by a display train comprised in a gear train mechanism or a gear train module and the output wheel set of which is formed by at least one indicator arranged to cooperate with a complementary indicator or with a dial comprised either in said display module or a timepiece incorporating said module.

22. The timepiece movement according to claim 17, wherein said movement includes at least one of said adjusted functional modules which is a time-setting module, the input wheel set of which is formed by a stem arranged to be moved by a user, and a first input wheel set of which is formed by a motion work control train.

23. The timepiece movement according to claim 22, wherein said time-setting module is a time-setting and winding module and includes a second output wheel set which is formed by a winding control train.

24. The timepiece movement according to claim 17, wherein said movement includes at least one of said adjusted functional modules which is a regulating module comprising an adjustment unit, and the input wheel set of which is formed by an escape wheel arranged to be moved by a fourth wheel comprised in a gear train or gear train module, and the output wheel set of which is formed by said same escape wheel.

25. The timepiece movement according to claim 17, wherein said movement includes at least one of said adjusted functional modules which is a self-winding module, the input wheel set of which is formed by an oscillating weight moved by the motions of a user or an external tool, and the output wheel set of which is formed by a drive train of a ratchet comprised either in a motor mechanism, or a motor module, or a ratchet which meshes with a barrel arbour comprised either in a motor mechanism or a motor module.

26. A timepiece including at least one movement according to claim 15.

27. A method for fabricating mechanical modular units each for a particular horological function, said method comprising:

adjusting said particular horological function of each of said modular units;

checking said particular horological function; and irreversibly adjusting said modular units prior to irremovably securing said modular units, wherein no further adjustment of said modular units is possible after said modular units are irremovably secured, wherein the irremovably securing said modular units includes irremovably securing at least one of said adjusted modular units to a front of a plate comprised in a timepiece movement and irremovably securing at least one of said adjusted modular units to a back of the plate.

28. A method for fabricating a timepiece movement including a plurality of mechanical modular units each for a particular horological function, said method comprising:

adjusting said particular horological function of each of said modular units;

checking said particular horological function on a test bench; and irreversibly adjusting said modular units prior to irremovably securing adjustment or assembling components comprised in said modular units, wherein no further adjustment of said modular units is possible after said adjustment or assembling components comprised in said modular units are irremovably secured, wherein each of said irreversibly adjusted and secured mechanical modular units is irremovably secured to a plate comprised in said movement or comprised in another said irreversibly adjusted and secured mechanical modular unit of said movement, or is irremovably secured to another adjusted functional module comprised in said movement, and wherein the irremovably securing includes irremovably securing at least one of said adjusted modular units to a front of the plate and irremovably securing at least one of said adjusted modular units to a back of the plate.

29. A method according to claim 28, wherein:

at least two said irreversibly adjusted and secured mechanical modular units are irremovably secured together or to a plate comprised in said movement.

30. A method according to claim 28, wherein:

at least one of said irreversibly adjusted and secured mechanical modular units is irremovably sandwiched between another of said irreversibly adjusted and secured mechanical modular units of said movement, or between a plate of said movement and one of said irreversibly adjusted and secured mechanical modular units of said movement.

* * * * *